United States Patent [19]

McKenna et al.

[11] Patent Number: 5,059,148

[45] Date of Patent: Oct. 22, 1991

[54] THIN FILM FLAT PANEL DISPLAYS AND METHOD OF MANUFACTURE

[75] Inventors: John F. McKenna, Newburyport, Mass.; Robert E. Brown, Stratham; Paul E. Gagnon, Farmington, both of N.H.

[73] Assignee: GTE Products Corporation, Danvers, Mass.

[21] Appl. No.: 136,222

[22] Filed: Dec. 21, 1987

[51] Int. Cl.[5] ..... H01J 9/26; H01J 9/395

[52] U.S. Cl. ..... 445/25; 445/43; 313/509

[58] Field of Search ..... 313/512, 509; 445/25, 445/43; 350/343

[56] References Cited

U.S. PATENT DOCUMENTS

| | | | |
|---|---|---|---|
| 3,330,982 | 7/1967 | Dickson . | |
| 3,926,502 | 12/1975 | Tanaka et al. | 350/343 |
| 3,970,363 | 7/1976 | Geyer et al. | 350/343 |
| 4,213,074 | 7/1980 | Kawaguchi et al. . | |
| 4,277,143 | 7/1981 | Pauli et al . | |
| 4,357,557 | 11/1982 | Inohara et al. . | |
| 4,447,757 | 5/1984 | Kawaguchi et al. . | |
| 4,810,931 | 3/1989 | McKenna et al. | 313/512 |

FOREIGN PATENT DOCUMENTS

| | | | |
|---|---|---|---|
| 70846 | 6/1978 | Japan | 350/343 |

OTHER PUBLICATIONS

"Liquid Crystal Cell Filling", by Edmonds et al., *IBM Technical Disclosure Bulleting,* vol. 16, No. 2, Jul. 1973.

J. Addy et al., IBM Technical Dislcosure Bulletin, vol 23, No. 11 (Apr. 1981).

*Primary Examiner*—Sandra L. O'Shea

*Attorney, Agent, or Firm*—Martha Ann Finnegan

[57] ABSTRACT

A thin-film electroluminescent (TFEL) display panel and method of fabricating a TFEL display are disclosed. The present invention relates to a TFEL display panel shielded by a pair of glass substrates with a protective material disposed therebetween wherein a metal washer is permanently bonded over the substrate oil fill orifices(s) and interfaces the cover glass. This metal washer is prepared in advance by pretinning with a solder to ease reflow after backfill process is complete. This solder provides the seal medium to close the backfill orifice. One of the advantages of using a soldered hole seal according to the present invention is that oil contamination becomes minimized. The backfill hole sealing is accomplished quickly in dry atmosphere without the presence of adhesives of flammable solvents.

5 Claims, 1 Drawing Sheet

THIN FILM FLAT PANEL DISPLAYS AND METHOD OF MANUFACTURE

BACKGROUND OF THE INVENTION

The present invention relates to a thin film electroluminescent (TFEL) display panel and more particularly, to a thin-film electroluminescent display panel shielded by a pair of glass substrates with a protective material disposed therebetween.

For general background information on TFEL panels, see the "EL Glass Catalog and Design Handbook," Planar Systems, Inc., Beaverton, Oreg. 97006, the contents of which, to the extent necessary, are hereby incorporated herein by reference.

A conventional TFEL display panel is illustrated in FIG. 1, wherein the panel comprises a first transparent glass substrate 1, a plurality of transparent electrodes 2 made of $In_2O_3$ or $SnO_2$, and the like, a first dielectric layer 3, an electroluminescent (EL) thin film 4, a second dielectric layer 5, a plurality of counter-electrodes 6 made of for example Al, spacers 10, and a counter-substrate or cover plate 11, which may be made of glass. See, for example, U.S. Pat. No. 4,213,074 to Kawaguchi et al.

As illustrated, the transparent electrodes 2 are arranged on the glass substrate 1 in parallel with each other. The counter-electrodes 6 are arranged so that they cross at a right angle relative to the transparent electrode 2 in a plane view. The cross points between each of the transparent electrodes 2 and the counter-electrodes 6 create a picture element (pixels) i.e., the image forming portion of the TFEL panel. A power source (not shown) is applied to the transparent electrode 2 and the counter-electrode 6.

The first dielectric layer 3 may comprise $Y_2O_3$, $TiO_2$, $Al_2O_3$, $Si_3N_4$, $SiO_2$, and the like, which may be deposited for example by a sputtering technique or by electron beam evaporation. The EL thin film 4 may be made for example, from a ZnS thin film doped with an impurity, for example manganese. The second dielectric layer 5 generally comprises a material similar to that of the first dielectric layer 3.

The TFEL panel is generally provided with a sealing structure for the EL composite member which comprises the first and second dielectric layers 3, 5 and the thin EL film 4. The cover plate 11, together with the transparent glass substrate 1, provide the basic structure for sealing the EL unit. The cover plate 11 need not be transparent because viewing may be conducted through the transparent glass substrate 1. One or more spacers 10 may be employed for positioning the cover plate 11. An adhesive 12 is coated for bonding the transparent glass substrate 1, the spacer 10, and the cover plate 11.

An adhesive 12 is generally employed, which may be an epoxy resin or the like. Lead terminals 15 of the transparent electrodes 2 and the counter-electrodes 6 may be formed on the transparent glass substrate 1 and extended toward the cavity. A control circuit (not shown) is coupled to the lead terminals 15 to apply the power to the EL unit.

A protective substance 13 may be added to the cavity defined by the two plates 1 and 11. A protective substance 13 functions to preserve the TFEL panel, especially the EL unit. The protective substance may be a gas or a liquid, but liquids are preferred. See, for example, U.S. Pat. No. 3,330,982 to Dickson, and U.S. Pat. No. 4,447,757 to Kinichi et al. Typical protective gases include inert gases such as nitrogen, argon, and the like. Typical protective liquids include silicon oils or greases.

A spacer 10 may be employed, and it may be formed from an insulating plastic sheet made of for example, a polyacetal resin or a polyimide resin, or a silicon rubber, or a glass plate. Finally, at least one fill hole 14 is generally provided, for the introduction of the protective substance 13.

If desired, a dye material or other color agent may be added to the protective substance in the TFEL panel to provide a background which can aid in the display characteristics of the panel.

TFEL panels of the type illustrated in FIG. 1 are very susceptible to moisture and therefore must be properly protected. To accomplish this moisture protection, most TFEL display panels employ a protective glass cover over the thin film depositions. This cover provides a space between the display substrate which is then filled with a liquid medium, generally oil based, which increases display life. The display cavity must be backfilled with oil in the absence of moisture. It is important to seal the oil fill orifice to prohibit moisture from entering the panel cavity.

Prior hole closing methods typically employed an adhesive material to either seal the oil fill opening or to bond a metal or glass closure over the the oil fill opening.

For example, Sharp Electronics (Japan) has used a fill tube adhered to the glass cover. After backfill was completed, the tubing was pinched off then covered/epoxied with a hollowed-out cover glass chip. See, U.S. Pat. No. 4,357,557, supra.

Planar Systems (USA) uses a system similar to the Sharp system, which entails backfilling the display panel with oil through an orifice in the cover glass, then plugging the opening with indium metal to prohibit oil leakage, while using an adhesive (epoxy) to seal a cover chip over the fill hole. See, the EL Glass Catalog and Handbook supra.

Both of these methods suffer from the disadvantages of long adhesive cure times; poor adhesion due to oil contamination of glass surface; and potential damage to the thin films due to contamination of the backfill oil by the adhesives employed.

SUMMARY OF THE INVENTION

The present invention overcomes the aforementioned problems encountered in prior art. Thus, the present invention is directed to a method of backfilling the display cavity with a protective fluid and to a means for sealing the cover plate opening quickly, thereby providing a hermetic seal which inhibits further moisture transmission into the display cavity.

The present invention interfaces the cover glass with a metal washer which is permanently bonded over the substrate oil fill orifice(s). This metal washer is prepared in advance by pretinning with solder to ease reflow after backfill process is complete. This solder provides the seal medium to close the backfill orifice.

One of the advantages of using a soldered hole seal according to the present invention is that oil contamination becomes minimized. The backfill hole sealing is accomplished quickly in dry atmosphere without the presence of adhesives or flammable solvents.

BREIF DESCRIPTION OF THE DRAWINGS

DETAILED DESCRIPTION OF THE PREFERRED EMBODIMENTS

Figure 1:
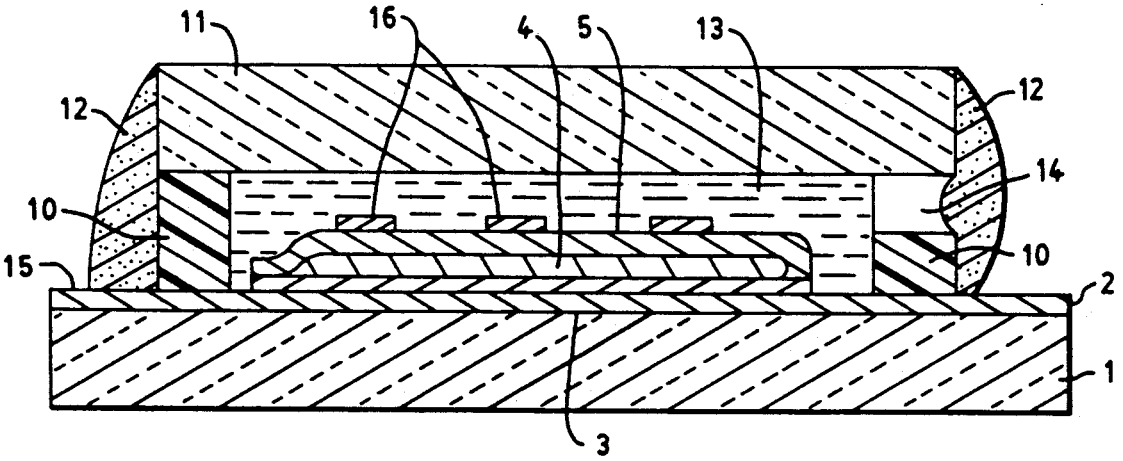
FIG. 1 illustrates a cross-sectional view of a typical thin film electroluminescent display panel.
Figure 2:
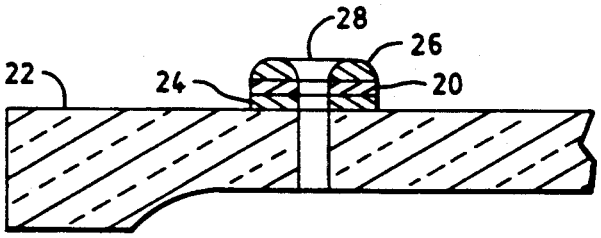
FIG. 2 illustrates a cross-sectional view of the cover plate closure means of the present invention, in the open position.
Figure 3:
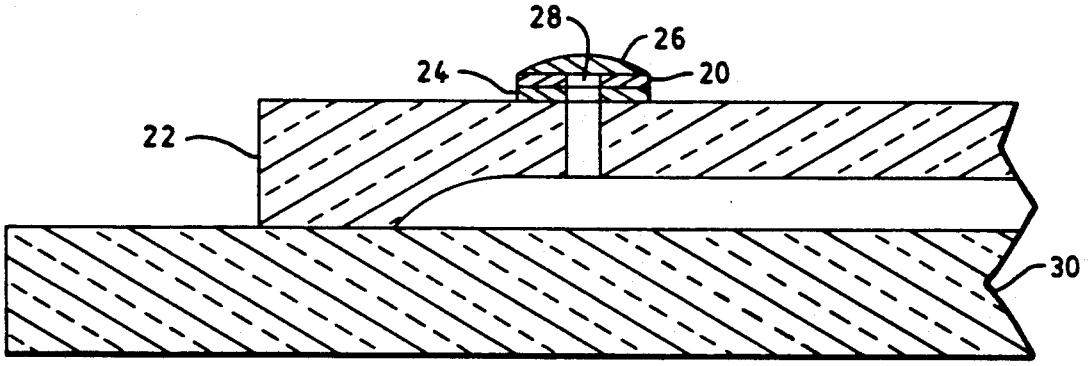
FIG. 3 illustrates a cross-sectional view of the cover plate closure means of the present invention, in the closed position.

The cover plate closure means of the present invention (open and closed positions) is shown in FIGS. 2 and 3, respectively.

The closure means comprises the combination of a metal, e.g.. Kovar, washer 20 which is bonded to the glass cover plate 22, e.g.. Corning 7059, using a heat curing epoxy adhesive 24.

The metal washer is pretinned with solder 26, for example with 50/50 tin lead solder by first cleaning the washer, e.g., with a fiberglass eraser, applying liquid rosin flux and then applying solder using a solder iron.

Prior to backfilling, the pretin solder is placed on the washer as shown in FIG. 2, i.e., with the hole 28 left open. If, during pretinning the hole closes over with solder, the hole can be opened, e.g., by reheating the solder with a solder iron until it remelts and then poking a hole through it, e.g., with a straight dental pick.

Kovar was selected as the preferred washer material because it is solderable and it matches the thermal expansion of the cover glass. Kovar is an alloy of iron, nickel, and cobalt, commercially available from the E. Fagan Company, Mahwah, N.J. However, any other glass and any other solderable metal can be used herein as long as the difference in thermal expansion between the metal washer and the glass is not high enough to cause cracking of the glass.

Similarly, any adhesive can be used that gives a strong enough bond to the glass, has a low moisture vapor transmission rate, and gives a leak tight seal. Likewise, many different solder compositions can be used as long as they adhere to the metal washer and are not too high in soldering temperature to cause deterioration of the metal to glass adhesive seal, or cause glass cracking. Solder glasses can also be used to bond the metal washer to the glass cover.

The pretinned Kovar washer cover is preferably cleaned after application of the solder, e.g., using isopropyl alcohol to remove any remaining flux.

The next step is the assembly of the TFEL panels. This is typically conducted in a dry box, and the modified cover plates are bonded to a TFEL substrate using an epoxy adhesive. The sealed panel is then backfilled with a protective fluid.

Typical protective fluids are silicone oils, e.g., Dow Corning Types 510 and 7401. Alternatively, there can be employed a class of fluids known as perfluorinated inert liquids as the protective fluid. These materials are especially exemplified by the Fluorinert® materials, particularly FC-40, FC-70, and FC-5312, available from the Commercial Chemicals Division of the 3M Company.

The two fill holes are then immediately closed merely by reflowing the pretinned solder using a solder iron which causes the solder to flow over and seal the hole as shown in FIG. 3. Additional solder can be added if necessary to ensure a complete closure of the fill hole.

The hole closing means of the present invention is ideal for use in a dry box because it is quick and does not require the use of liquid adhesives. Adhesives are typically difficult to work with, are very messy and require extended time to cure. Further, the solder hole closing method of the present invention is noncontaminating to the protective fluids which are used to fill the panel.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A method of fabricating a thin-film electroluminescent display panel on a transparent substrate comprising;

disposing a cover plate relative to the transparent substrate in such a manner as to define a cavity therebetween, said cavity containing a thin-film electroluminescent composite member;

providing said cover plate with at least one fill hole, said fill hole being peripherally surrounded by an annular washer member, said washer member bearing sufficient solder to close said fill hole; and introducing a protective liquid into said cavity through said fill hole.

2. The method according to claim 1, further including melting the solder on said annular washer member to cover and seal said fill hole.

3. The method of claim 1, which further comprises providing a washer member comprising a metal having sufficient ductility to accommodate the differences in thermal expansion of the cove plate material.

4. The method of claim 1, which further comprises providing a washer member comprising a metal having a coefficient of thermal expansion approximating that of the cover plate material.

5. The method of claim 1, which further comprises adhesively binding said washer member to said cover plate.

* * * * *